United States Patent [19]

Richard et al.

[11] 4,192,120

[45] Mar. 11, 1980

[54] METHOD OF CONSTRUCTING REINFORCED CONCRETE BRIDGES

[75] Inventors: André J. Richard, Liege; Philippe M. Delmotte, Ramillies-Offus; Pierre A. Parthoens, Bassenge, all of Belgium

[73] Assignee: Entreprises de Travaux Publics et Privés J. Richard Société Anonyme, Loncin-Liége, Belgium

[21] Appl. No.: 859,529

[22] Filed: Dec. 12, 1977

[30] Foreign Application Priority Data

Dec. 17, 1976 [BE] Belgium ..... 45795

[51] Int. Cl.[2] ..... E04G 21/02; E04B 1/32

[52] U.S. Cl. ..... 52/741; 52/87; 52/127; 52/326; 264/32

[58] Field of Search ..... 52/88, 87, 741, 127, 52/326, 174; 264/32

[56] References Cited

U.S. PATENT DOCUMENTS

| | | | |
|---|---|---|---|
| 541,213 | 6/1895 | Platt | 52/87 |
| 591,949 | 10/1897 | Cheney | 52/87 |
| 762,361 | 6/1904 | Strauss et al. | 52/87 |
| 820,921 | 5/1906 | Cheney | 52/88 |
| 1,074,268 | 9/1913 | Kelly et al. | 52/88 |
| 1,121,313 | 12/1914 | Watson | 52/174 X |
| 1,728,265 | 9/1929 | Farnham et al. | 52/174 X |
| 2,786,349 | 3/1957 | Coff | 52/223 R |
| 2,844,024 | 7/1958 | McDonald | 52/326 |
| 3,113,402 | 12/1963 | Butler | 52/326 X |

OTHER PUBLICATIONS

Engineering News-Record, Feb. 18, 1937, pp. 270, 271.

*Primary Examiner*—Alfred C. Perham

*Attorney, Agent, or Firm*—Blanchard, Flynn, Thiel, Boutell & Tanis

[57] ABSTRACT

In a method of constructing a reinforced concrete bridge a supporting arch is erected which comprises a cocked center part of which forms a supporting reinforcement intended to be incorporated in the concrete of the final bridge structure. Shuttering is placed in position on the arch and the concrete poured to embody the supporting reinforcement and constitute the deck of the bridge. The resultant deck is formed by a ribbed slab, by girders connected by a slab, or by at least one box. After the concrete has hardened the remaining exterior part of the arch is removed, and if required additional reinforcement may be embodied in the concrete.

7 Claims, 3 Drawing Figures

METHOD OF CONSTRUCTING REINFORCED CONCRETE BRIDGES

BACKGROUND OF THE INVENTION (1) Field of the Invention

This invention relates to a method of constructing reinforced concrete bridges and it includes bridges constructed by the method.

The conventional method of constructing such bridges utilises arches serving as a lower framework support for building the bridge in reinforced concrete.

(2) Description of the Prior Art

Such arches constitute scaffolding which is generally supported on the banks, particularly on the abutments, and on the eventual piers, and also on pilework arranged between the eventual piers. This method of procedure presents many disadvantages, especially with bridges to be constructed over navigable waterways. In fact, the river structure to be built necessitates recourse to caissons, temporary pilework, etc., which constitute obstacles to traffic on the reach of the river and which may not satisfy the requirements with regard to tidal clearance and the waterlogged surface of the site. Even if the bridge is to be constructed over waterways which are not navigable, the construction of the supporting structure generally necessitates pilework which may be undesirable because of the attendant obstacle to the free circulation of the water. Lastly, and whatever the field of application, the use of arches as a supporting structure is a procedure which entails considerable delays and costs and which, even in special cases, it may be virtually impossible to achieve because of the nature of the terrain, the spans to be obtained, etc.

It is theoretically possible to imagine a method of construction entailing recourse to a provisional construction comprising braced pylons mounted on the piers of the bridge to be built and supporting a horizontal girder which supports, in its turn, a lower scaffolding. The lower scaffolding, attached to the horizontal girder, is intended to support framework by means of stays which pass through the superstructure of the bridge and, in particular, the deck.

Not only would such a method be difficult to carry out because of the considerable height of the pylons, but it would pose very complex problems related, in particular, to the difficulties of overcoming the deformation of the support framework during concreting. The use of stays passing through the superstructure also constitutes a disadvantage.

SUMMARY OF THE INVENTION

The purpose of the invention is to provide a remedy for the aforementioned disadvantages by means of a simple and rapid method of constructing bridges without entailing building costs greater than those of conventional methods. In addition, the invention aims at providing a method which can be adapted to the particular geometry of the bridge, to the possibly unfavourable nature of the obstacle to be crossed and to the implantation of the bridge in the site.

The method of constructing bridges in reinforced concrete by concreting in shuttering supported by an arch according to the invention is characterized in that a cocked centre is erected, at least a part of which forms a supporting reinforcement and is intended to be incorporated in the concrete of the final structure, and in that the shuttering is then placed in position and the supporting reinforcement is embodied in concrete to constitute the deck of the bridge formed by a ribbed slab, by girders connected by a slab, or by at least one box.

The invention equally relates to a bridge obtained by this method, in which at least one part of the arch, having served in the construction of the work, is embodied in it after concreting, the steelwork thereof thus contributing to the strength of the bridge.

The method described is of particular interest in that it offers the possibility of constructing the box bridges easily, as it permits the formwork of the lower slabs to be simplified by using precast concrete slabs placed, after erection of the arch, at the lower part of the supporting reinforcement. In this way, a work platform is obtained enabling the remainder of the reinforced concrete superstructure to be easily completed.

With advantage, the part of the arch forming the supporting reinforcement may comprise a series of lattices of the same shape as the bridge girders and resting on the eventual piers.

It is generally desirable to provide, in addition to the part of the arch intended to be incorporated in the concrete, an exterior part which is dismantled after the concrete has set.

Said exterior part of the arch may be situated above or below the supporting reinforcement and is with advantage composed of lattice work in very tall sections integral with those incorporated in the concrete, forming an assembly with sufficient rigidity to overcome the problem of deformation of the arch under the weight of the fresh concrete.

The integration of the two parts of the arch may be such that the latter consists of small one-piece girders for the exterior part and the part intended to be incorporated, which necessitates cutting out the exterior part of the arch after the concrete of the superstructure has hardened.

It is equally possible for the two parts of the arch each composed of small girders to be bolted together, so that the exterior part can be simply dismounted after the concrete of the superstructure has hardened.

In addition to the supporting reinforcement provided by the arch it may of course be necessary to provide additional reinforcement complementary to the supporting reinforcement and which is also to be incorporated in the concrete, so as to obtain the necessary strength of the bridge.

The construction of a box bridge is easily achieved employing the invention and, because of the ease of construction, it is possible to provide for instance, as calculation often shows to be desirable, an intrados of varying thickness.

Other objects and features of the present invention will appear more fully below from the following detailed description considered in connection with the accompanying drawings which disclose one preferred embodiment of the invention. It is to be expressly understood, however, that the drawings are designed for purposes of illustration only and not as a definition of the limits of the invention, reference for the latter purpose being had to the appended claims.

DESCRIPTION OF THE PREFERRED EMBODIMENT

Figure 1:
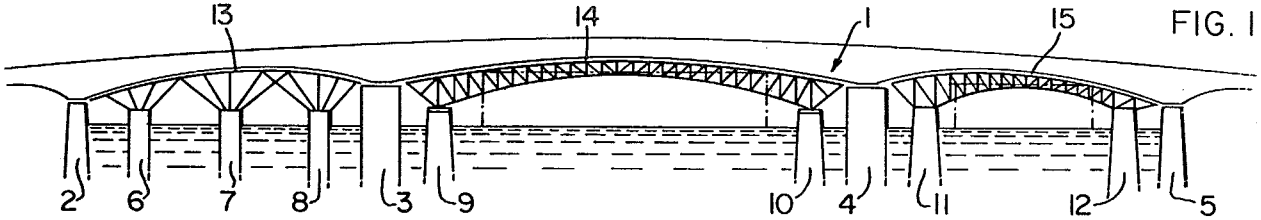
FIG. 1 illustrates a method of the present state of technology, using a conventional arch.

In the conventional method of FIG. 1 the construction of a bridge 1 necessitates, in addition to the eventual piers 2, 3, 4 and 5, a certain number of auxiliary intermediate pileworks 6 to 12.

In principle, construction of the arch 13 resting on the piers 2,3 and pileworks 6, 7 and 8 poses few problems. On the other hand, construction of the arch 14, resting on piers 3 and 4 and pileworks 9 and 10, and of the arch 15, resting on piers 4 and 5 and pileworks 11 and 12, presents considerable difficulties if two navigable channels have to be kept between the pileworks. Construction of these arches is necessarily slow, onerous and hardly practical, if not impossible, for large spans.

Figure 2:
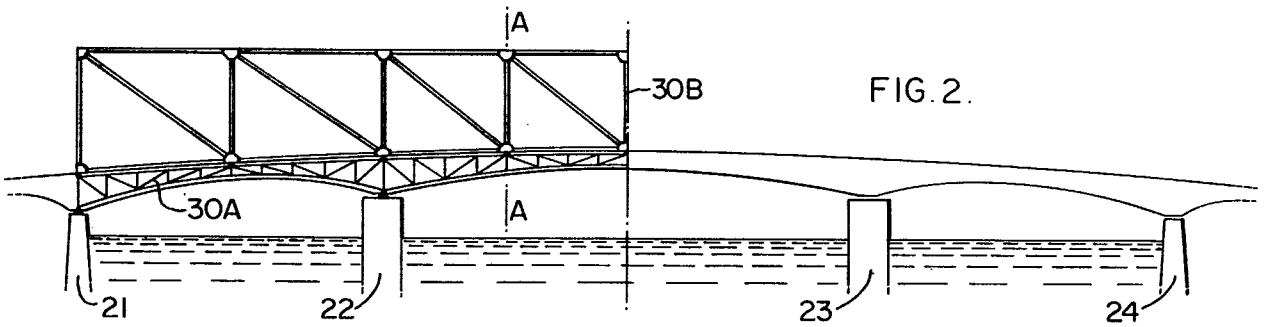
FIG. 2 illustrates schematically the method of construction of the invention showing in side view a bridge under construction.
Figure 3:
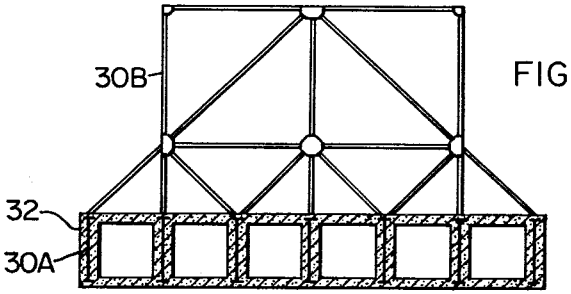
FIG. 3 is a section on the line A—A in FIG. 2.

In the method of construction in accordance with the invention illustrated in FIGS. 2 and 3, a box bridge of variable height, constructed of reinforced concrete, is obtained by carrying out the following phases in turn.

Firstly, simultaneously with the construction of the arch in the workshop, the infrastructure of the work, consisting of two piers 22 and 23 and two abutment piers 21 and 24, is constructed on site.

The arch prefabricated is then installed in position and, as described above, this is effected either by providing two parts, that is to say the exterior part 30B and the reinforcing part 30A to be incorporated in the final structure, which are detachable, for example by employing a system of bolts, or by installing the arch without arranging for the two parts which constitute it to be relatively detachable.

The arch constituted by the two parts 30A and 30B rests, in the method of construction illustrated, directly on the abutments and the piers, and the form of the part 30A to be incorporated corresponds essentially to that foreseen for the complete work. However, if necessary, other forms of construction different from those illustrated are possible. In particular, it is possible not to have the arch resting directly on the piers and/or the abutments, or to adopt a form of the part 30A to be incorporated in the concrete which is different from the general shape of the bridge. In certain cases, in addition to the part 30A to be incorporated in the superstructure of the concrete and the upper exterior part 30B, it is possible to provide another exterior part, this time lower, it being understood that all the exterior parts are intended to be removed when the work is completed.

After installation of the arch, precast slabs are placed at the lower framework of the part 30A intended to be incorporated in the concrete. This on the one hand provides a casing bottom for concreting the bridge and, on the other hand, also provides the considerable advantage of forming a working platform which allows the shuttering to be erected for the concrete in which will be incorporated the part 30A of the arch provided for this purpose. Complementary steel members, constituting additional reinforcement, may be added to the supporting reinforcement provided by the part 30A intended to be incorporated in the concrete of the bridge to be constructed.

Concreting is effected in the conventional manner, the finished arch being calculated to accommodate the deformation of the shuttering. Of course, concreting must be effected in such a way as not to throw out of balance the work in course of construction. In general, concreting is done progressively in successive sections, proceeding equally to the left and to the right from a pier and concreting symmetrically with respect to the axis of the bridge. The successive phases of concreting with a possible hardening stage between each phase are planned so as to take into account inertias in time and space. In the method of construction illustrated, reinforced concrete boxes 32 are produced incorporating the part of the arch 30A provided for this purpose.

The technical progress obtained by the invention rests on the fact that the technique described in effect combines the advantages of metal bridges built out from piers or abutments and those of reinforced concrete, particularly the advantages of economy of the latter.

Moreover, by making the part incorporated in the concrete act initially as a support for fresh concrete and then as reinforcement for the concrete, this arch enables considerable savings to be made in the quantities of steel used.

The employment of the invention is especially advantageous:

1. when the time allowed for construction is short (in fact, assembly of the panels either in the workshop or at the work site allows the time required for erecting the arch in position to be considerably reduced),
2. when the great height of the piers would make such scaffolding necessary,
3. when the zones between piers are difficult of access: rugged areas, marshy zones, rivers, inhabited zones, etc.

The type of arch proposed may be adapted to all forms of reinforced concrete bridges. In particular, it allows what until the present time has been practically excluded to be done, that is to cross with large spans of reinforced concrete overhanging zones unsuitable for the installation of scaffolding.

Although preferred methods of carrying out the process for achieving the invention have been described, it should be understood, of couse, that these have been given merely by way of illustration, in order to facilitate an understanding of the invention and without any intention of limitation of the scope of the invention. Consequently, numerous variations are possible, both in the conception of the bridge itself as in that of the arch, modifications of the conception of the bridge, in particular, necessarily entailing adaptations of the form and construction of the arch.

It should in addition be noted that the expression "arch" as used herein is to be understood in its usual technical sense of scaffolding allowing bridge decks to be constructed, but that such an arch does not necessarily have an arched or curved shape.

We claim:

1. A method of constructing bridges of reinforced concrete, including the steps of providing a supporting arch having a reinforcing part intended to be embedded into the concrete and an exterior part intended to be taken down after the concrete has set, the supporting arch having a cocked center, erecting the supporting arch on a pair of horizontally spaced supports, placing shuttering in position on the arch, and embodying at least the reinforcing part of the arch in concrete to constitute the deck of the bridge which is formed by a ribbed slab, by girders connected by a slab or by at least one box, said part of the arch embodied in the concrete providing supporting reinforcement in the final bridge structure.

2. A method according to claim 1, wherein precast concrete slabs are placed, after erection of the arch, at the lower part of the reinforcing part, so as to serve as a bottom closure for the shuttering.

3. A method according to claim 1, wherein the reinforcing part comprises a series of lattices of the same shape as the bridge girders and resting on the eventual piers.

4. A method according to claim 1, wherein the exterior part of the arch is situated above the reinforcing part and is composed of lattice work in tall sections integral with the reinforcing part as incorporated in the concrete, the reinforcing and exterior parts forming an assembly with sufficient rigidity to prevent excessive deformation of the arch under the weight of the fresh concrete.

5. A method according to claim 1, wherein the exterior part of the arch is situated below the reinforcing part and is composed of lattice work in tall sections integral with the reinforcing part as incorporated in the concrete, the reinforcing and exterior parts forming an assembly with sufficient rigidity to prevent excessive deformation of the arch under the weight of the fresh concrete.

6. A method according to claim 1, wherein the two parts of the arch are integrated by producing an arch consisting of small one-piece girders for the exterior part and the reinforcing part, separation of the two parts being obtained by cutting out the exterior part of the arch after the concrete of the superstructure has hardened.

7. A method according to claim 1, wherein the two parts of the arch are composed of small bolted girders, so that the exterior part may be easily detached after the concrete of the superstructure has hardened.

* * * * *